US005302332A

United States Patent [19]

Simola et al.

[11] Patent Number: 5,302,332

[45] Date of Patent: Apr. 12, 1994

[54] METHOD FOR MANUFACTURING A MAT-LIKE PRODUCT CONTAINING MINERAL FIBERS AND A BINDING AGENT

[75] Inventors: Jarmo Simola, Kuusisto; Jean Le Bell, Kaarina; Ulf Westerlund, Parainen, all of Finland

[73] Assignee: Roctex Oy AB, Parainen, Finland

[21] Appl. No.: 27,477

[22] Filed: Mar. 8, 1993

[30] Foreign Application Priority Data

Mar. 9, 1992 [FI] Finland ..... 921011

[51] Int. Cl.[5] ..... D04H 1/56

[52] U.S. Cl. ..... 264/119; 65/9; 264/518; 264/115; 264/121; 264/122

[58] Field of Search ..... 264/6, 518, 115, 119, 264/121, 122; 65/9

[56] References Cited

U.S. PATENT DOCUMENTS 5,032,334 7/1991 Jonsson et al. ..... 264/113
5,123,949 6/1992 Thiessen ..... 65/4.4
5,145,626 8/1992 Bastioli et al. ..... 264/112

FOREIGN PATENT DOCUMENTS 2173523 10/1986 United Kingdom .
WO90/1511-81 12/1990 World Int. Prop. O. .

*Primary Examiner*—Mary Lynn Theisen
*Attorney, Agent, or Firm*—Pollock, Vande Sande & Priddy

[57] ABSTRACT

In the method for manufacturing a product in the form of a mat containing mineral fibers and a binding agent, the binding agent is mixed with the fibers before the formation of the product. The material used as the binding agent includes thermoplastic particles, such as fibers, a powder, or particles in a dispersion, which are supplied to the fibers being formed of melted mineral into the stream of air. The fibers and the binding agent are carried by a turbulent air flow, in which the heat contained in the melting mineral and the fibers forming therefrom are used for melting or softening thermoplastic particles into a state, in which they effect the binding of the fibers to each other.

14 Claims, 1 Drawing Sheet

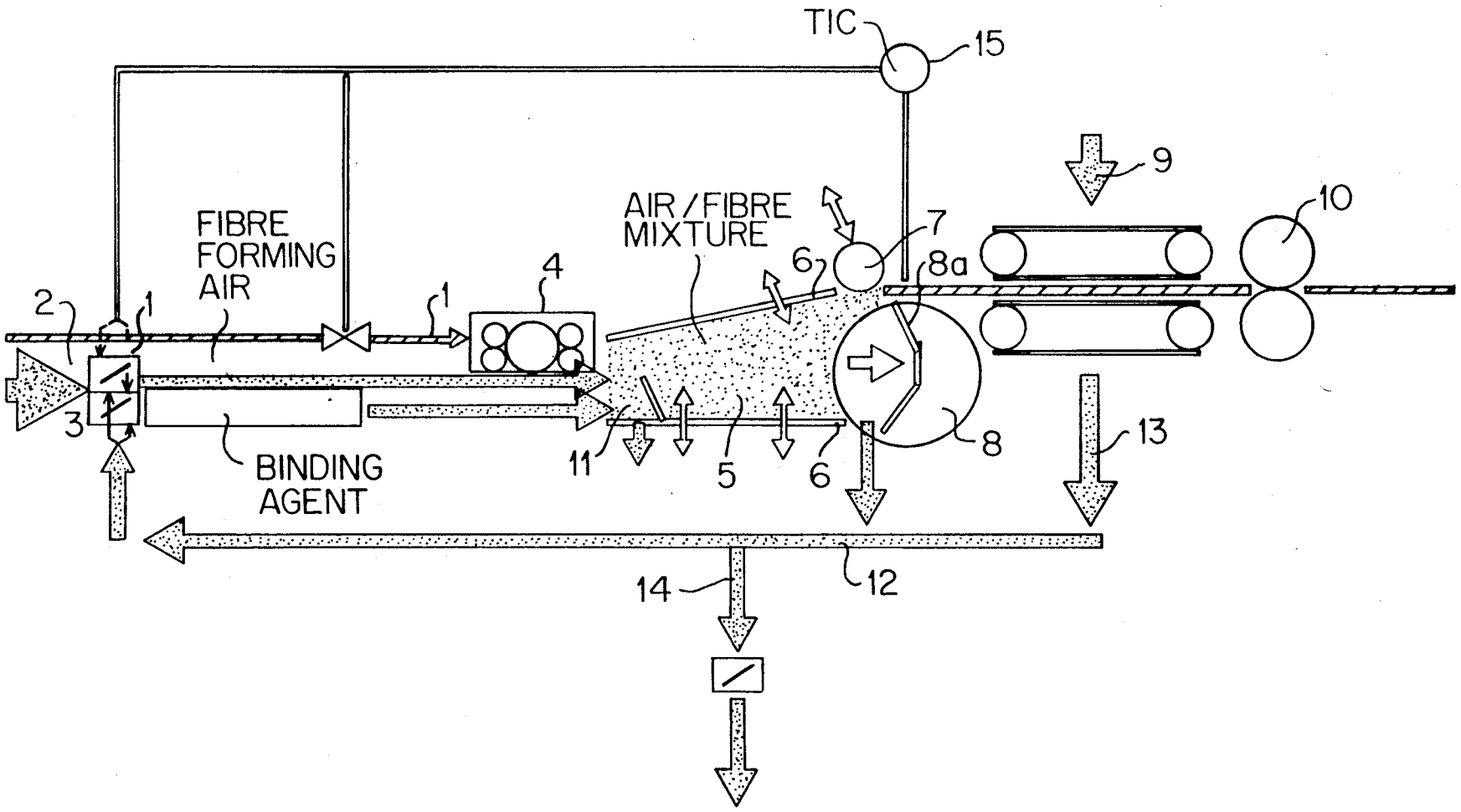
10
9
13
15
TIC
7
8a
8
12
6
6
AIR/FIBRE MIXTURE
5
14
11
4
1
BINDING AGENT
FIBRE FORMING AIR
1
2
3

METHOD FOR MANUFACTURING A MAT-LIKE PRODUCT CONTAINING MINERAL FIBERS AND A BINDING AGENT

BACKGROUND OF THE INVENTION

The present invention relates to a method for manufacturing a product in a form of a mat containing mineral fibers and a binding agent, in which method the binding agent is mixed together with the fibers before the formation of the product.

In the manufacture of mats formed of mineral fibers, the fibers are produced by conveying melted material on centrifugal wheels or inside perforated drums which sling the material by the centrifugal force outwards as thin fibrous pieces. At the same time, air is blown from the side of the centrifugal wheels in a direction perpendicular to the slinging direction, whereby the pieces are simultaneously directed to a certain direction and cooled down by air. The fibers are carried by the air flow onto an air-permeable support, through which the air flow passes, and on this support they form a felt, which is conveyed by the support to aftertreatment devices. Production methods of this kind are described, for example, in Finnish Patents No. 76842 and 77272.

For binding mineral fibers into a homogeneous mat, a suitable liquid binding agent, which will harden, is sprayed on the fibers in fluid form before the settling of the fibers into a mat. At the same time as the fibers are formed, a suitable cooling agent, such as water, is mixed with them for securing a sufficiently quick cooling of the fibers. Next, the matting formed on the support is usually subjected to heat treatment by raising its temperature again for hardening the binding agent, at which stage the final density and thickness of the product is determined. After this, the product can be worked further in a number of ways, for example, by sawing, cutting, or the like.

In the present application, the term mineral fibers is used to denote stone fibers, glass fibers, ceramic fibers, or slag fibers.

In the prior art methods mentioned above, the binding agent in general use is phenol-based resin which is sprayed on the surface of the fibers and used for hardening the mat at the later stage of heat treatment. A problem with the use of such resin lies in the environmental and health risks involved. Furthermore, a long heating time and, respectively, a long heating oven is required for hardening the resin, thus increasing the costs on investment and energy in the lines of mat manufacture.

SUMMARY OF THE INVENTION

It is an aim of the present invention to provide a method by which it is possible to achieve quick binding of the product by a binding agent and, on the other hand, exploitation of the heat contained in the melted raw material of mineral fibers in the formation of the product. To attain this aim, the method according to this invention is primarily characterized in that the material used as the binding agent is thermoplastic particles, such as fibers, a powder, or particles in a dispersion, which are, in connection with the manufacture of the mineral fibers, mixed with the fibers formed of melted material and supplied into air, and the fibers and the binding agent are carried away by a turbulent air flow, in which the heat contained in the melted material and in the fibers formed of it is utilized for melting or softening the thermoplastic particles into a state, in which they effect the binding of the fibers to each other.

Thermoplastic particles are used as the binding agent, which is mixed with the fibers to be formed of the melted material. The fibers and the binding agent are formed into a mixture passing forward in a turbulent air flow, such as a dispersion consisting of air, fibers and binding agent particles in which dispersion the heat of fiber formation, such as the heat content of the melted material forming the raw material of the fibers, is used for bringing the thermoplastic particles into a state where they glue the fibers to each other. The fibers that are solidified from the melted state in connection with the fiber formation emit the melting heat to the surrounding air, wherefrom it is transferred to the thermoplastic particles. At the same time, the turbulent air flow mixes the fibers and the binding agent particles into a homogeneous mixture, and at the time of settling of the mixture into a solid mat on a support, the binding agent particles are readily in a state in which they glue the fibers to each other. As the formed mat is cooled down, the binding agent particles are hardened, and a finished bound product is achieved. The binding agent is environmentally safe, and the stage of heat treatment in the process remains short.

According to an advantageous embodiment of the method, the quantity and/or the temperature of a cooling agent which is supplied to the mixture of the fibers and the thermoplastic particles in the air is used to adjust the temperature of the air surrounding the thermoplastic particles to a suitable level. The mixture of fibers and thermoplastic particles is advantageously formed in a chamber substantially closed off from the surrounding air.

According to an advantageous embodiment of the present invention method, in order to control the manufacturing process and save energy, the air flow having carried the fibers and the binding agent and/or the air flow having cooled the mat formed thereof, is conducted to the beginning of the process and used for adjusting the temperature of the air surrounding the thermoplastic particles.

The invention relates also to the use of products manufactured by the method in the manufacture of compression-molded mineral fiber products.

BRIEF DESCRIPTION OF THE DRAWINGS

In the following, the invention is described in more detail by reference to the appended drawing, which shows a side view of the apparatus in which the method according to the invention can be applied.

DETAILED DESCRIPTION OF THE INVENTION

The drawing shows an apparatus comprising a fiber-forming centrifuge 4 for mineral fibers, to which the melted material is supplied in a known manner and which will be surrounded by slung fibrous pieces which will be next solidified. A group of centrifuge wheels or a perforated drum can be used as the fiber-forming centrifuge. By means of fiber-forming air blown from a pipe 2 around the centrifuge, the fibers are directed to a certain direction, in this case to a special chamber 5 closed off from surrounding air, which is at the opposite end provided with a collecting drum 8 with an air-permeable surface, functioning as the support for mat formation. For accelerating the cooling of the melted fiber material, water serving as a cooling agent can be sprayed from the pipe 1 to the chamber 5.

The thermoplastic binding agent to be used according to the invention, which may consist of thermoplastic fibers, a powder, or particles in a dispersion, is fed with the flow of air or liquid conveyed by a pipe 3. This flow is mixed with the fiber-forming air in such a way that a turbulent air flow forward towards the suction drum 8 functioning as the support for mat formation is generated in the chamber 5, the binding agent and the fibers being mixed well together in the air flow. When a dispersion is used, the conveying liquid, such as water, evaporates upon entering the chamber. At the same time, heat released during the solidification of the fibers is transferred to the thermoplastic material with the results described above. The air flow is directed by the suction effective inside the suction drum 8 as the air flow, which conveys fibers and binding agent to the surface of the suction drum, and passes through the shell of the drum. The drum is rotatable, whereby the finished mat-like product exits as a continuous mat through a gap between the drum and one wall limiting the chamber. The binding agent can be fed to a suitable part of the chamber from the pipe 3 so that it is carried away by the fiber-forming air and mixed into the fibers, preferably as close as possible to the fiber-forming centrifuge 4 at the proximal end of the chamber.

The FIGURE shows also how the temperature of the air in the chamber 5 can be adjusted to be suitable for the material used as the binding agent. At the point of mat exit, there is a temperature sensor giving a signal by means of which a control means 15 controls the quantity of the water used as the cooling agent or the relative flow rates of the air returned from the end of the process and the fresh fiber-forming air taken from the outside, which determine the temperature of the air entering the chamber 5. The adjustment can be performed by changing either one or both of the flow rates. Alternatively, it is possible to regulate the temperature by keeping the quantity of the cooling agent supplied from the pipe 1 constant and adjusting only its temperature.

The material used as the binding agent, which is supplied either as fibers, a powder or a dispersion, can be a polymer which at a suitable temperature range, for example, between 100° C. and 200° C., comes to a glueing state, such as polyethylene, polypropylene, polyester, polyamide, or some other thermoplastic polymer. When fibers are used, use is made of staple fibers which can be carried by an air flow, either as such or using opening means, to the chamber 5. The temperature of the air in the chamber 5 is adjusted to a suitable range by one of the methods described above. It is also possible to use bicomponent fibers, such as polyethylene-polyester fibers, polyethylene-polypropylene fibers, or fibers containing polyamide and another polymer. In bicomponent fibers, part of the fiber consists of a binding material melting or softening at the temperature used, the part of the second material, for example, the core or the other half, remaining in a solid state. Thermoplastic binding agents also give the product good elasticity and flexibility, and this can be influenced by the choice of the proportion of the binding agent. The content of the binding agent can be for example, 1.0 to 50.0 wt-%, preferably 5 to 30 wt-% of the total weight of the product.

It is also possible to use mixtures of different binding agent particles, for example fibers of different lengths or binding agent particles of different materials.

The FIGURE shows also some structural details of the apparatus. For example, on the bottom of the chamber 5, a compartment 11 is arranged at the end near the fiber-forming centrifuge 4 for collecting the heavier beads being formed in connection with the fiber formation. By adjusting the height of the wall separating the compartment, it is also possible to have an effect on the turbulence in the chamber and to remove a certain proportion of the beads for regulating the purity of the product. There are plates **8*a* inside the suction drum 8 for adjusting the extent of the suction sector of the drum and consequently the orientation of the fibers influencing the thickness of the mat. The feed rate of the fibers being constant, the weight per square meter of the product can be regulated by adjusting the speed of rotation of the suction drum 8. Furthermore, it is possible to regulate the orientation of the fibers by arranging the position of the upper or lower wall 6 of the chamber 5 to be adjustable. It is also possible to equip the chamber with a diffuser structure which is generally known. At the point of mat exit, there is also a press cylinder 7, whereby its position can be adjusted for regulating the density of the mat exiting from the gap between it and the suction drum 8, because the mat can still be well compressed at this stage. After the drum 8, the mat passes to the conveyor, at which point cooling air 9 is supplied across the mat for solidifying the thermoplastic binding agent. Usually only a 10° to 20° C. cooling is sufficient for quick hardening of the particles of the binding agent. The final shaping to a certain density can still be performed after this stage by conveying the mat between cooled press rolls 10. For giving the product a surface pattern, rolls with a surface pattern can be used. Alternatively, the product can be pressed by press rolls only, in which case the press cylinder 7** is not needed.

The drawing shows also the possibility that air discharged from the chamber 5 through the suction drum 8 is circulated through a pipe 12 to the fiber-forming air pipe 2 for controlling the temperature in the chamber 5 by proportioning the quantities of air, as described above. As an alternative or parallel means, a desired proportion of circulating air can be conducted through the pipe 12 also to the pipe 3 in the case that thermoplastic material is supplied through it by air. Hot exhaust air can also be utilized elsewhere, as illustrated by a pipe 14 leaving the pipe 12. The air circulation may also incorporate the mat cooling air 9 through a pipe 13 connected to the pipe 12.

The obtained mat can also be subjected to further processing by a number of ways. For example, it can be re-pressed to a certain shape by using temperature and pressure, whereby the material used as the binding agent is softened and hardened again, hardening the product into a new shape. By doing so, the thermoplastic properties of the material used as the binding agent are utilized in an optimal way.

The method can be used for example for the manufacture of the following products:

compression-molded thermoplastic products,
flexible insulating sheets,
dense sound-proofing felts,
mineral wool mats which are thinner than the conventional products.

We claim:

1. A method for manufacturing a product in the form of a mat containing mineral fibers and a binding agent, said method comprising the steps of:

melting a mineral and forming fibers from the melted mineral;

mixing the resulting hot mineral fiber in a mixing zone with solid thermoplastic particles defining said binding agent in a turbulent stream of air such that said fibers and said thermoplastic particles are carried away from said mixing zone by said stream of air, whereby heat contained in the hot mineral fiber brings said thermoplastic particles into a state in which they bind the mineral fibers to each other.

2. A method according to claim 1, wherein a cooling agent, is supplied tot he mixture of the mineral fibers and the thermoplastic particles in the air, for adjusting the temperature of the air surrounding the thermoplastic particles to a suitable level.

3. A method according to claim 1, wherein the binding agent is mixed with the fibers by conveying it by a separate flow.

4. A method according to claim 1, wherein the mixture of fibers and thermoplastic particles is formed in a chamber substantially closed off from the surrounding air and in which said mixing zone is defined.

5. A method according to claim 4, where the mineral fibers and the thermoplastic particles are collected into a mineral fiber mat at the distant end of the chamber, as seen in the main direction of the air flow, on a movable, air-permeable support, through which the air flow carrying the mixture in the chamber is passed.

6. A method according to claim 5, wherein the mat is cooled down by an air flow blown through it, whereby the thermoplastic binding agent is hardened and binds the mineral fiber mat into its shape.

7. A method according to claim 6, wherein the mat is calendered at the end of the cooling stage to compress the mixture of fibers and the binding agent into a final density.

8. A method according to claim 6, wherein the mat is calendered at the end of the cooling stage to press the surface of the mat into a pattern.

9. A method according to claim 6, wherein the air flow after having cooled the mat formed of the fibers and binding agent is conducted to the air flow carrying the mixture of the fibers and thermoplastic particles for adjusting the temperature of the air surrounding the thermoplastic particles.

10. A method according to claim 1, wherein the air flow which carried the fibers and the binding agent is conducted back into the air flow carrying the mixture of the fibers and thermoplastic particles for adjusting the temperature of the air surrounding the thermoplastic particles.

11. Method according to claim 2, wherein the binding agent is mixed with the fibers by conveying it by a separate flow.

12. Method according to claim 5, wherein the fibers and the thermoplastic particles are collected into a mineral fiber mat at the distant end of the chamber, as seen in the main direction of the air flow, on a moveable, air-permeable support, through which the air flow having carried the mixture in the chamber is passed.

13. A method for manufacturing a product in the form of a mat containing mineral fibers and a binding agent, said method comprising the steps of:

melting a mineral and forming fibers from the melted mineral;

mixing the resulting hot mineral fiber in a mixing zone with thermoplastic particles defining a binding agent in a turbulent stream of air such that said fibers and said thermoplastic particles are carried away from said mixing zone by said stream of air, whereby heat contained in the hot mineral fiber brings said thermoplastic particles into a state in which they bind the mineral fibers to each other and forming said mat; and compression-molding of said mat containing the mineral fibers and the solidified thermoplastic binding agent to a desired shape using temperature and pressure.

14. A method according to claim 13, wherein the mixture of fibers and thermoplastic particles is formed in a chamber substantially closed off from the surrounding air and in which said mixing zone is defined.

* * * * *